United States Patent [19]

Dong et al.

[11] Patent Number: 5,004,626

[45] Date of Patent: Apr. 2, 1991

[54] ANODES AND METHOD OF MAKING

[75] Inventors: Dennis F. Dong, Kingston, Canada; Richard E. Loftfield, Jacksonville, Fla.

[73] Assignee: Huron Technologies, Inc., Kingston, Canada

[21] Appl. No.: 359,263

[22] Filed: May 31, 1989

Related U.S. Application Data

[63] Continuation-in-part of Ser. No. 923,363, Oct. 27, 1986, abandoned.

[51] Int. Cl.[5] ..... B05D 5/12

[52] U.S. Cl. ..... 427/58; 427/77; 427/125; 427/123; 427/126.3; 427/126.5; 427/229; 427/257; 427/380; 427/383.7; 204/290 F

[58] Field of Search ..... 204/290 R, 290 F, 291, 204/292, 293; 429/43; 427/58, 123, 125, 226, 126.3, 126.5, 229, 372.2, 380, 77, 383.7, 419.2, 419.3

[56] References Cited

U.S. PATENT DOCUMENTS

| | | | |
|---|---|---|---|
| Re. 28,820 | 5/1976 | Beer | 204/290 F |
| 3,096,272 | 7/1963 | Beer | 204/290 F |
| 3,177,131 | 4/1965 | Angell et al. | 204/290 F |
| 3,234,110 | 2/1966 | Beer | 204/290 F |
| 3,236,756 | 2/1966 | Beer | 204/290 F |
| 3,265,526 | 8/1966 | Beer | 204/290 F |
| 3,632,498 | 1/1972 | Beer | 204/290 F |
| 3,711,385 | 1/1973 | Beer | 204/59 |
| 3,711,397 | 1/1973 | Martinson | 204/290 F |
| 3,751,296 | 8/1973 | Beer | 204/290 F |
| 3,773,554 | 11/1973 | Scrutton et al. | 204/290 F |
| 3,773,555 | 11/1973 | Cotton et al. | 204/290 F |
| 3,775,284 | 11/1973 | Bennett et al. | 204/290 F |
| 3,778,307 | 12/1973 | Beer | 204/290 F |
| 3,864,163 | 2/1975 | Beer | 204/290 F |
| 3,933,616 | 1/1976 | Beer | 204/290 F |
| 3,986,942 | 10/1976 | Cook | 204/290 F |
| 4,052,271 | 10/1977 | Beer | 204/38 A |
| 4,098,671 | 7/1978 | Westerlund | 204/290 F |
| 4,112,140 | 9/1978 | Heikel et al. | 427/126 |
| 4,140,813 | 2/1979 | Hund et al. | 204/290 F |
| 4,222,842 | 9/1980 | Bouy et al. | 204/290 F |
| 4,362,707 | 12/1982 | Hardee et al. | 423/478 |
| 4,589,969 | 5/1986 | Yurkov et al. | 204/290 F |

FOREIGN PATENT DOCUMENTS

| | | | |
|---|---|---|---|
| 932699 | 8/1973 | Canada . | |
| 932700 | 8/1973 | Canada . | |
| 936836 | 11/1973 | Canada . | |
| 6606302 | 11/1966 | Netherlands | 204/290 F |
| 1402414 | 8/1975 | United Kingdom | 204/290 F |

OTHER PUBLICATIONS

Morita, M. et al., "The Anodic Characteristics of Modified Mn Oxide Electrode: Ti/RuOx/MnOx" Electrochim. Acta 23, pp. 331-335 (1978).

Loucka, T., "The Reason for the Loss of Activity of Titanium Anodes Coated with a Layer of $RuO_2$ and $TiO_2$", *J. Of Applied Electrochemistry,* 7 (1977), pp. 211-214.

Modern Chlor-Alkali Technology, 1 (1979), pp. 108-117.

Bergner, D. et al., "The Operation of Long-Life Anodes in Amalgam Cells", *J. of Applied Electrochemistry,* 13 (1983), pp. 341-350.

*Primary Examiner*—John F. Niebling
*Assistant Examiner*—Kathryn Gorgos
*Attorney, Agent, or Firm*—Beveridge, DeGrandi & Weilacher

[57] ABSTRACT

An electrode base comprising a valve metal core provided with an ultimately protective, barrier precursor forming coating which is dried at relatively low temperature; e.g. room temperature to 280° C. prior to application of an electrocatalytic precursor forming coating thereon. The step of pre-formation of a barrier layer is eliminated.

12 Claims, 1 Drawing Sheet

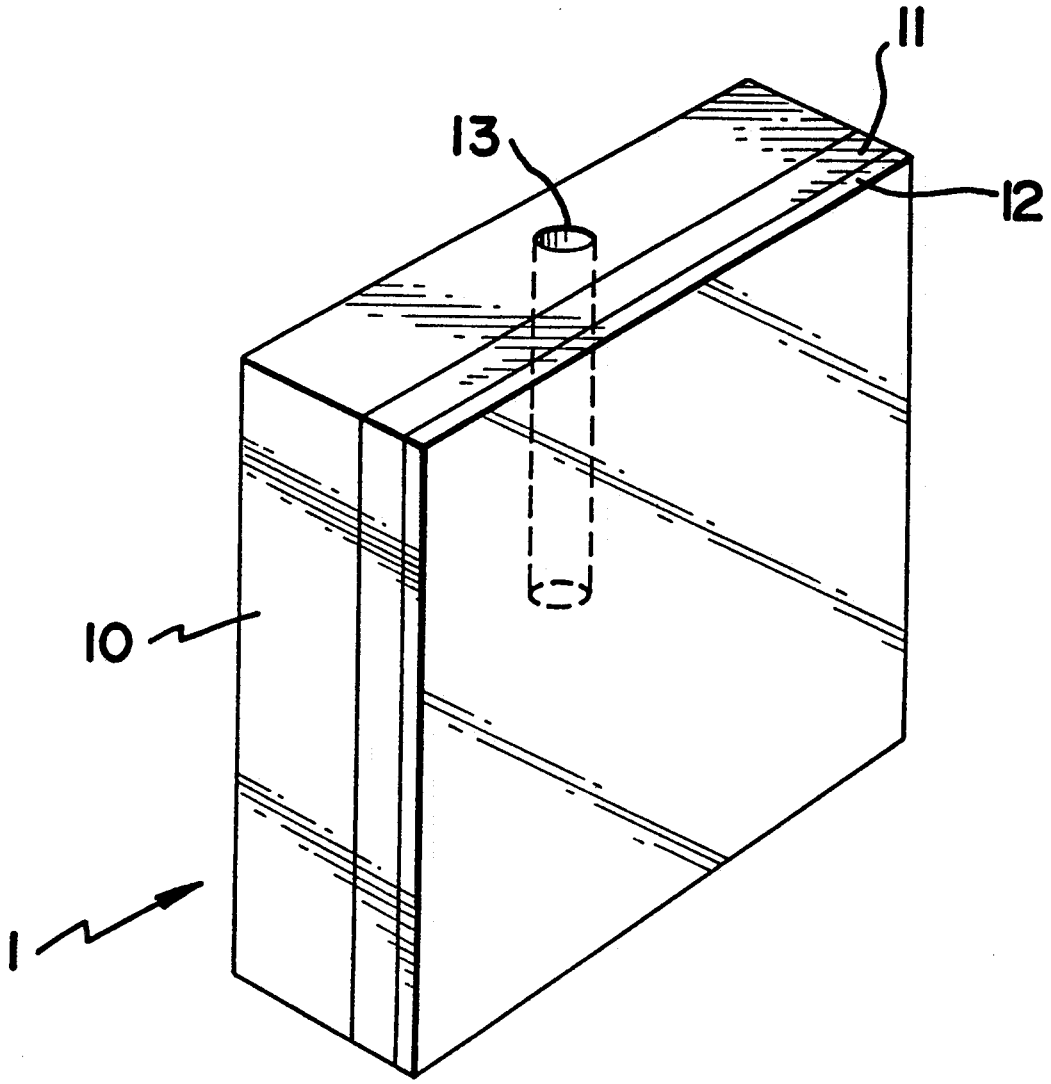
11
13
12
10
1

ANODES AND METHOD OF MAKING

REFERENCE TO A RELATED APPLICATION

This is a continuation-in-part of copending application Ser. No. 923,363 filed Oct. 27, 1986 now abandoned which is relied on herein.

INTRODUCTION

The present invention relates to anode technology and a method of making anodes which comprises a base or core of conductive metal, an electronically conductive barrier layer on the base or core, and on the surface of the barrier layer an electrocatalytic coating which will ionically transfer electric current between the anode and the electrolyte. These anodes are particularly suitable for use in an electrochemical process, such as for the electrolysis of alkali metal salts, water, or other aqueous solutions, or in desalination cells, cathodic protection systems, and other similar electrochemical systems. The anodes in accordance with the present invention are especially useful for the electrolysis of alkali metal halides, such as sodium chloride to produce oxyhalogen compounds such as sodium chlorate. The invention further pertains to a method of coating a base with a barrier layer, the resulting intermediate product and the anodes produced as final products.

BACKGROUND OF THE INVENTION

Metal anodes of valve metal such as titanium or alloys thereof having electrocatalytic coatings of platinum metals, platinum metal oxides, mixtures of valve metal oxides or other oxides with platinum metal oxides, and so-called mixed crystal material for use in the electrolytic alkali chlorate and chlorine cell fields have been of much interest in recent years. In this art, the term "film-forming metal" is also used to refer to the valve metals. The problems of protecting the valve metal base, also known as the anode substrate, of such anodes from attack and damage under electrolysis conditions have also been of interest. Platinum metal coated anodes have been described in U.S. Pat. Nos. 3,177,131 and 3,265,526. Platinum metal oxide coatings have been described in U.S. Pat. Nos. 3,711,385, 3,864,163, Reissue 28,820, and 4,052,271 (or Canadian Patent 932,699). Dutch Patent 6,606,302 of Nov. 14, 1966, discloses platinum metal oxide coatings wherein this material is mixed with non-platinum metal oxide. These publications disclose an electrode and the method of making such an electrode consisting of a core of film-forming metal or alloy thereof, to which is applied a thin coating of platinum metal oxide, and which core of film-forming metal may be in the form of a jacket over a conductive material isolated from the electrolyte. The art further teaches, particularly in respect to titanium as the core of film-forming metal, the creation of a porous oxide layer thereon to promote adhesion of the platinum metal oxide, or the application of the precious metal oxide to porous titanium and then subsequent rolling to reduce the porosity.

Mixtures of a valve metal oxide such as titanium dioxide with a precious metal oxide to form the electrocatalytic coating on a valve metal core or base for use as an anode are described in U.S. Pat. Nos. 3,773,554 and 4,112,140, and variations thereof are elsewhere described, as for example, in Dutch Patent 6,606,302, above cited, wherein the use of a valve metal oxide as the non-platinum metal oxide is described.

So-called mixed crystal material of a platinum metal oxide with a film-forming metal oxide which is described in terms of its behavior in ionic electrical energy conductance in contact with the electrolyte and is applied as a coating to a valve metal base or core and with the film-forming metal oxide comprising more than 50% of the coating, is disclosed in German Patent application 1,671,422, published Oct. 19, 1972. Still other prior art; namely, U.S. Pat. Nos. 3,632,498; 3,751,296; 3,778,307; 3,933,616 (or Canadian Patent 932,700) disclose an electrode and the method of making such electrodes comprising a base of a metal or metal alloy or non-metallic conductor such as graphite upon which is a coating of so-called mixed crystal material comprising 50 mole percent or more of the oxide film-forming metal together with up to 50 mole percent of oxide of a precious metal. This art teaches the means of making such electrode by coprecipitation upon a base of conductive film-forming metal of the same metal as of the film-forming metal oxide. Also taught in this art is the making of the electrode by sputtering techniques and by electro deposition. Coprecipitation of the film-forming metal oxide with the conducting precious metal oxide onto the film-forming base, according to the art, firmly adheres the precious metal oxide to the film-forming substrate in a manner not heretofore possible.

The problems of the electrolysis product attack on the valve metal base or core of such catalytic anode coatings disclosed in the above references is disclosed in U.S. Pat. No. 3,096,272 in which a barrier layer of titanium oxide is formed between the pores of the noble metal coating by high temperature (800°) thermal methods and U.S. Pat. No. 3,236,756 by electrochemical methods. U.S. Pat. No. 3,234,110 discloses an electrode comprising a core of titanium metal or an alloy thereof to which is applied by electrolytic deposition a barrier layer of titanium oxide and over the surface of which is applied a platinum (noble) metal catalytic coating. U.S. Pat. No. 3,773,555 discloses an improved method of applying a barrier layer of film forming metal oxide on a film-forming metal core prior to applying the catalytic coating of a platinum metal or an oxide of a platinum metal.

By "valve metal" or "film-forming metal" is meant a metal or alloy which, when connected as an anode in the electrolyte and under the conditions in which the metal or the alloy is subsequently to operate as an anode, exhibits the phenomenon that within a few seconds the passage of the electrolysis current drops to less than 1% of the original value. For purposes of this invention, examples of these metals are titanium, titanium alloys, tantalum, tantalum alloys, zirconium, zirconium alloys, niobium, and niobium alloys and tungsten and tungsten alloys. Thus, the terms "film-forming metal" and "valve metal" are used herein in accordance with their art recognized meaning.

More recently, it has been thought that at least one of the modes of anode passivation or anode coating failure is the gradual build-up of a non-conducting titanium oxide layer between the applied catalytic coating and the titanium core. See T. Loucka, Journal of Applied Electrochemistry, 1977. This oxide layer would form if, over a period of time, enough oxygen diffuses through the coating and reacts with the titanium underneath the coating to form an insulator over the conductive metal core. The anode passivation can be delayed by applying a thicker precious metal coating, but this is undesirable from an economic point of view. The passivation may also be delayed by providing a conductive layer which acts as a barrier to oxygen diffusion or by providing a non-oxide forming inter-layer. This is also undesirable because of difficulties caused by increased electrode resistance (between layers) as well as adhesion of the outer coating.

Difficulties in the art of making platinum (noble) metal and platinum (noble) metal oxide coated anodes with a satisfactory economic long life are further evidenced by "Modern Chlor-Alkali Technology," Volume 1, (1979) pp. 108–117. Mechanical breakage occurs because of changes in the stress pattern of platinum metal coatings from dissolution of the platinum and gas bubble impingement, and attack on the titanium core through pores in the coating. U.S. Pat. No. 4,140,813 addresses this problem by disclosing the flame or plasma spraying of from 50 to 6,000 grams/$m^2$ of titanium oxide onto the core or base prior to application of the electrochemically active substance containing a platinum metal or oxide thereof. The functioning of such barrier layers is described in the Journal of Applied Electrochemistry 13 (1983) pp. 341–350 authored by D. Bergner and Katowski.

Other prior developments have proposed intermediate layers in electrode manufacture. For example, Martinson, U.S. Pat. No. 3,711,397 suggests using an intermediate electroconductive layer as a binding agent.

Westerlund, U.S. Pat. No. 4,098,671 proposes an intermediate layer of $MoS_2$ for a coated cathode. Bouy et al. U.S. Pat. No. 4,222,842 discloses an intermediate layer of oxide or hydride of titanium.

It is, therefore, apparent that difficulties in maintaining in service adhesion of the platinum metal or platinum metal oxides to conductive valve metal cores or bases, and avoidance of passivation thereof and attack by the electrolytic products on the cores or bases through the pores of the platinum metal or platinum metal oxide coatings have been encountered in carrying out prior art methods. As a result, complicated and/or expensive manufacturing or processing procedures have been developed in an attempt to overcome the deficiencies.

As a further indication of this, in U.S. Pat. No. 3,775,284, Bennett and O'Leary teach the use of an electrodeposited layer of platinum, which is subsequently heated at 450° C. Not only is this platinum layer required before the subsequent intermediate barrier layer is applied, but involves both an electrodeposition step as well as a relatively high temperature baking step. They state that "it appears at this time that the heat treatment is critical since it has been found that the solid solution coating will not adhere to the untreated metal itself . . . " (column 4, lines 14–17).

Other prior art which suggests use of an intermediate barrier layer is typified by the use of a relatively higher temperature requirement for the formation of a suitable barrier layer, such as in Canadian Patent 936,836, or in U.S. Pat. No. 3,986,942.

With regard to the use of titanium based anodes and titanium based cathodes, the electrodes or electrode substrate coatings are known not to be generally interchangeable. Titanium metal, being a valve metal, will passivate when polarized anodically; under cathodic polarization, however, the titanium will not passivate, but will continue to pass electrical current, even after titanium hydride forms on the surface under hydrogen evolution conditions. Titanium anodes, therefore, require protective (and catalytic) coatings under anodic, oxidizing conditions.

SUMMARY OF THE INVENTION

A feature of this invention resides in a method for making an electrode for use in electrolytic cells, for example, for the production of chlorates or chlorine or hypochlorites and the like, preferably as an anode in such cells, wherein a precursor of the barrier layer is deposited on at least a portion of the surface of the electrode base or core and dried at relatively low temperature without any significant decomposition of the precursor. Thereafter, an electrocatalytic metal top coating is deposited thereon to produce an intermediate product, which after baking, is converted into the final product. The electrodes made in accordance with this invention can also be used as cathodes.

A still further feature of the invention resides in providing an anode substrate which comprises an electronically conductive valve metal base having a precursor barrier coating thereon.

A further feature of the invention resides in the method for providing an anode comprising an electrocatalytic metal coating on top of the barrier coated electronically conductive valve metal base.

The above and other features of this invention enable a reduction in total heat energy consumed in the process and obtaining a saving in time of the overall process.

BRIEF DESCRIPTION OF DRAWING

The present invention is further illustrated by the drawing which shows a simplified version of an isometric view of a section of an electrode of the invention.

DETAILED DESCRIPTION OF THE INVENTION

In further detail, the electrode of the invention for use as an anode in electrochemical processes comprises (a) an electronically conductive valve metal core or base on which is applied (b) an electronically conductive barrier layer of mixed compound of the valve metal base material and of a platinum group metal and over which is applied (c) an ionically conductive catalytic coating of a platinum group metal or a mixture of platinum group metals. By the term "platinum group metal" is meant a noble metal of Group VIII of the Periodic Table of Elements; i.e. platinum, iridium, rhodium, palladium and ruthenium.

Described in further detail, the drawing shows an electrode (1) formed of a conductive base or core (10) of a valve metal, and deposited thereon, a barrier layer (11) electronically conductive and resistant to the electrolysis conditions, a catalytic active coating (12) ionically conductive to the electrolyte deposited over the barrier layer, and a cavity (13) representing the means of connecting the electric current conductor to the electrode.

The cavity (13) can be of any convenient number or size and is typically fitted with internal threads for attachment to an electric current conductor. Alternate means to connect to a source of current can also be used such as by bonding a conductive sheet to the opposite surface of base (10). In this case, the coating, barrier layer, and base may be put onto the other face of the conductive sheet.

In carrying out the present invention, the electrode base, which can be a "film-forming metal" or "valve metal" as hereinbefore described, is generally first cleaned. Titanium is the base or substrate of greatest commercial interest. Before coating the titanium substrate, the substrate should be first degreased according to any suitable technique, such as using an organic solvent, e.g. acetone or chloroform. Thereafter, the substrate is subjected to suitable acid etching as is known in the art, e.g. using a hot, 30 to 32 weight %, solution of hydrochloric acid, at a temperature of 30° to 110° C., for 1 to 60 minutes. After rinsing and drying, the substrate is ready for coating. Etching techniques and compositions used therefor are widely known in the art. As a result of the etching step, the surface of the electrode base is very rough. This surface condition helps to hold the barrier coating solution to the surface of the base and enables drying thereof to produce a coated surface.

The preparation of the barrier layer of the present invention is carried out in two stages, as follows.

First, a barrier coating forming solution is applied to the surface of the base, and it is essentially dried at a relatively low temperature.

Drying at room temperature up to about 280° C., preferably 100° to 275° C., and most preferably 200° to 270°, is carried out. Drying can be carried out in air, with forced air such as a fan, or with heated air as is known in the art. The duration of drying is not critical provided sufficient time is available to dry the coating.

Multiple applications of the barrier coating solution can be used, followed in each instance with the drying cycle. Generally, at least one cycle is carried out, although two or more coatings can also be applied. One coating applied in accordance with the method of the present invention is normally adequate to form a deposit on the electrode base. The finished coating appears to the eye to be a continuous film.

At this point the barrier layer has not yet been formed, since only the barrier layer precursor from the barrier coating solution, has been applied.

The second stage involves the application of the catalytic coating solution onto the coated base. This catalytic coating solution is then dried, to form the catalytic layer precursor.

The intermediate product of the invention thus is characterized by the electrode base being coated with a precursor of the barrier coating adjacent the valve metal or alloy base, and a top or outer coating of catalytic precursor.

At this point, the coated base containing the catalytic layer precursor and the barrier layer precursor is not an electrode suitable for use in the field of the invention, since both the catalytic layer and the barrier layer have not yet been formed. In fact, under anodic electrolysis conditions both precursor coatings would be quickly destroyed, and the underlying film-forming base would passivate.

Formation of the barrier layer and catalytic layer occurs approximately simultaneously during the subsequent baking step at relatively high temperature.

Usually, a multiple of coats of the catalytic coating solution are applied, e.g. 4 or 5 times, although more or fewer coats can be used as will be understood by the art. Drying of the catalytic coating solution is usually carried out between multiple coats.

We have found that a particularly useful barrier layer for the electrolysis of alkali metal halides is a composition formed from a ruthenium salt compound and a titanium compound as the valve metal component.

Any suitable compound of ruthenium and titanium can be used for purposes of the invention as will be apparent to those skilled in the art. Generally, these compounds are soluble in the organic solvents depending upon quantities used. Such compounds are well known in the art as noted above and need not be listed herein. For example, thermally decomposable compounds are well known and any suitable ones may be used. The prior art referred to herein is relied on for the disclosure concerning known components of titanium and ruthenium. The relative proportions of ruthenium and titanium compounds used in accordance with the described process are conventional. Generally, proportions of 45 to 10 mole percent of ruthenium and 55 to 90 percent of titanium are suitable. Preferred compositions are 30:70 mole percent Ru:Ti.

In the prior art, pre-formed barrier layers, formed almost entirely of the valve metal of the base applied as the oxide thereof have been applied under high energetic conditions—thermal, electrochemical, plasma. In general, barrier coatings of the past have been dried at 350° and higher resulting in thermal decomposition or oxidization to an extent that is substantially complete. In contrast thereto, a feature of the present invention resides in essentially drying, but not seeking to decompose or oxidize the deposited material, at generally lower temperatures and energy conditions than have heretofore been used for barrier coatings. In other words, the present invention does not require the pre-formation of a barrier layer, and in fact eliminates the need for this pre-formation step.

Although not completely verified, it is believed that this barrier layer precursor contains the essentially dried metal compounds of titanium and ruthenium, i.e. dried coating formed of solutions containing the metal compounds deposited on the base which is then dried at relatively low temperatures. It is further believed that the barrier layer after application of the catalytic layer retards or prevents oxygen from penetrating to the base and forming thick resistive oxide film under the layer and causing mechanical damage to it and to the active anode coating over it. Other protective mechanisms may however be active.

The preferred barrier coating composition of the present invention is a solution or suspension of a ruthenium salt such as the chloride and an organic titanate such as tetrabutyl orthotitanate in an acidic alcohol. Any suitable lower alcohol (e.g. 1-5 carbons) can be used but butyl alcohol is preferred. The barrier coating compositions are somewhat viscous, similar to a paint compositions and therefore are partially dissolved suspensions or slurry like in texture and composition. The proportions of solvent are not critical, sufficient solvent being used to provide the desired consistency for application to the substrate. These compositions are then capable of forming a somewhat tacky or paint like coating on the electrode base. The compositions can be made by simply mixing the ingredients together. Hydrochloric acid is preferably used to acidify the solution, i.e., to produce an acid pH (less than 7). Other mineral acids could also be used. A 36% solution of HCl is typical for purposes of this invention. Sufficient acid is added to the barrier coating compositions to render the composition of a suitable acidity; as for example, a pH of 1 to 2. However, there is nothing narrowly critical about the pH conditions provided that enough acid is present to prevent an unwanted amount of hydrolysis of the components.

After the barrier coating precursor is applied and dried, the electrocatalytic metal top coating is applied by formulating a composition of decomposable platinum group metal compounds such as chloroplatinic acid and iridium salts such as iridium trichloride. Gold and silver compounds can also be used. Typically, a solvent such as a lower alcohol or mixture of alcohols is present together with an organic reducing agent. The lower alcohol can be an alcohol of 1 to 5 carbon atoms. Other alcohols can be used if convenient. The reducing agents suitable for the invention are many, such as linalool and, more preferably, ethylene glycol or a substituted ethylene glycol. Ethylene glycol has the advantage over some other reducing agents since it does not have a strong objectionable odor. Other reducing agents used in coating compositions can also be employed for present purposes. This type of composition is applied by spraying, rolling, brushing onto the barrier layer precursor coated-electrode base and then drying. Usually, a multiplicity of coats of the noble metal top coating are applied; e.g. 4 or 5 times. A more or less number of coatings can be used. After drying, baking takes place at about 300°-600°, preferably about 425°. A post bake step of baking at higher temperature; e.g. 500°-550° C. for 24 hours or more has been found to be suitable.

It should be noted that the barrier layer must be of different composition than the catalytic layer (the electrocatalytic metal top coating) in order for an effective electrode of the present invention to be obtained. Of necessity then, the composition of the barrier layer precursor solution and that of the catalytic layer precursor solution must be different.

A number of metals have been used in the past for the outer, or top, electrocatalytic surface. Usually these are platinum-group metals such as platinum, palladium, rhodium, iridium, ruthenium, osmium and mixtures thereof as well as gold and silver.

These metals have been termed "noble" metals or "precious" metals. For the purposes of the present invention, these terms are used interchangeably for the platinum group metals as listed.

The techniques for painting these compositions onto electrodes are well developed as is shown in the art. Preferred for purposes of this invention are platinum, iridium combinations. The percentages and proportions used are conventional.

The following examples are presented to illustrate the present invention and are not intended to be limiting:

EXAMPLE 1

A titanium sheet approximately 2" by 1" was used for this example. The sheet was washed with water and acetone, and then etched for 15 minutes in 32% HCl at 80° C. The following coating mixture was then prepared:

| | |
|---|---|
| $RuCl_3.3H_2O$, | 1 gram |
| Tetrabutyl orthotitanate | 3 ml |
| HCl (36%), | 0.4 ml |
| Butanol, | 15 ml |

The piece was coated once, and then dried at 280° C. Thereafter, the piece was coated with 5 coats of the following noble metal formulation:

| | |
|---|---|
| Chloroplatinic acid | 0.4 g |
| Iridium trichloride | 0.12 g |
| Isopropanol | 5 ml |
| Linalool | 5 ml |

Baking at 425° C. was carried out after each coating with the noble metal composition.

A final post bake of 550° C. for 4 hours was used.

This electrode was tested in a small sodium chlorate cell with 300 g/l of NaCl and 1.2 g/l sodium dichromate. The electrolyte temperature was approximately 65° C.

Current density was 2 amps/in$^2$. The cell exhibited a current efficiency of 95.8%, a cell voltage of 3.1 V and by-product oxygen of 1.33% by volume in hydrogen.

The substrate can be shaped into any desired configuration for use as an electrode, and may comprise a cast or wrought base having at least a portion of a surface of the base formed of a valve metal, such as titanium.

EXAMPLE 2

A titanium sheet approximately 2" by 1" was used for this example. The sheet was washed with water and acetone, and then etched for 15 minutes in 32% HCl at 100° C. The following coating mixture was then prepared:

| | |
|---|---|
| $RuCl_3.3H_2O$ | 1 gram |
| Tetrabutyl orthotitanate | 3 ml |
| HCl (36%) | 0.4 ml |
| Butanol, | 15 ml |

The piece was coated twice, and then dried at 275° C. after each coat.

Thereafter, the piece was coated with 8 coats of the following noble metal formulation:

| | |
|---|---|
| Chloroplatinic acid | 0.4 g |
| Iridium trichloride | 0.12 g |
| Isopropanol | 5 ml |
| Ethylene glycol | 5 ml |
| Ethanol | 2 ml |

Baking at 424° C. was carried out after each coating with the noble metal formulation.

A final post bake of 550° C. for 4 hours was used. The typical odor of the linalool reducing agent was not present.

The electrode was tested in a small sodium chlorate cell with 300 g/l NaCl and 1.2 g/l sodium dichromate. The electrolyte temperature was approximately 65° C. Current density was 2 amperes per square inch. The cell exhibited a current efficiency of 96.3%, a cell voltage of 3.O V, and by-product oxygen of 1.23% by volume in hydrogen.

Various barrier coatings treated at various temperatures were tested to ascertain performance characteristics.

The barrier coating solution consisted of 1 gram of ruthenium trichloride hydrate, 3 ml of titanium orthobutyltitanate, 0.4 ml of hydrochloric acid, and 15 ml of butanol. The solution was applied to pieces of 3"×5" titanium mesh, previously etched in hot hydrochloric acid. Two coats were applied, each coat being heat treated for three minutes at the following temperatures as shown below. The barrier coatings were then tested in standard sodium chlorate electrolysis cells as in previous examples, with the following results:

TABLE I

| Sample | Heat Treatment Temperature, °C. | Result |
|---|---|---|
| A | 250 | Corroded within 10 minutes. |
| B | 270 | Corroded in 34 hours. |
| C | 280 | Corroded in 17 hours. |
| D | 290 | Not corroded after 48 hours, average voltage 3.44 V. |
| E | 300 | Not corroded after 64 hours, average voltage 3.48 V. |
| F | 350 | Not corroded after 64 hours, average voltage 3.39 V. |

As can be seen from the results shown above, barrier coatings heat treated at 290° C. or higher perform satisfactorily as anodes for at least 48 hours. Those heat treated at 280° C. or lower fail quickly as anodes. It would be entirely expected that further catalytic coatings formed on top of the former group would perform as anodes satisfactorily. What is unexpected, is that, following treatment in accordance with the invention, further catalytic coatings formed on top of the latter group, treated at lower temperatures, also perform satisfactorily as anodes. It is believed that the barrier layer can form effectively in spite of the catalytic top coat having been applied.

In confirmation of this, test anodes have been manufactured with the same top coat, but with barrier coatings applied at various temperatures. The Ru-Ti coating solutions were as indicated above. The Pt-Ir coating solution consisted of:

3.1 g chloroplatinic acid,
1 g iridium trichloride,
55 ml isopropanol,
6.7 ml ethanol,
8.6 ml ethylene glycol.

Two coats of the barrier coating solution were applied, each being dried at the temperature indicated in Table II. Six coats of the top coat solution were applied on top of the dried barrier coating solutions, each coat being baked at 425° C. for 10 minutes and finally post-baked at 550° C. for 5 hours. These coatings were tested in standard sodium chlorate current efficiency (CE) test cells, and cell voltages and byproduct oxygen were measured. The cell voltages were corrected for temperature and sodium chloride concentration to 65° C. and 200 gpl, respectively.

TABLE II

| Sample | Barrier Coating Drying Temperature % | C.E. | Cell voltage (V) | % $O_2$ in H |
|---|---|---|---|---|
| G | 270 | 95.6 | 3.14 | 1.15 |
| H | 280 | 94.3 | 3.23 | 1.27 |
| I | 300 | 96.1 | 3.30 | 1.21 |
| J | 350 | 95.2 | 3.17 | 1.20 |

As can be seen from the results in Table II, the performance of the anodes with barrier coats dried at 270°-280° C. is equivalent to that of the anodes dried at 300°-350° C.

The advantage of drying the barrier coating solutions at lower temperatures is reduced heat energy consumption, and economy of time saving, since there is a shorter heating-up time in the baking oven, as well as a shorter cool-down time, before the next coat is applied.

Variations and modifications of the foregoing will be apparent to those skilled in the art and are intended to be encompassed by the claims appended thereto.

We claim:

1. A method for making an electrode suitable for use in an electrochemical process, comprising:

providing a base formed at least partially of at least one valve metal or alloy thereof, applying to said base a first composition which is a barrier precursor forming composition comprising a compound of ruthenium, a compound of a film-forming metal and a solvent, to form a coated layer on said base, thereafter subjecting said coated base to heating at a temperature from room temperature up to about 280° C. for a sufficient period of time to dry said coated base without significant decomposition or oxidation of said compound of ruthenium and said compound of film-forming metal, then, without baking the coated base to decompose and oxidize therein said compound of ruthenium and said compound of film-forming metal, applying to said coated base at least one coating from a second composition, different from the first, which second composition contains a solvent and an organic reducing agent and is a noble metal compound containing composition capable of forming an electrocatalytic coating, and thereafter baking the said base to which said second composition is applied at a temperature of 300°-600° C.

2. The method of claim 1 wherein a thermally decomposable compound of ruthenium is used.

3. The method of claim 1 wherein a thermally decomposable compound of a film forming metal is used.

4. The method of claim 1, wherein said film-forming metal is selected from the group consisting of titanium, titanium alloys, tantalum, tantalum alloys, zirconium, zirconium alloys, niobium, niobium alloys, tungsten and tungsten alloys.

5. The method of claim 1, wherein said valve metal base is selected from the group consisting of titanium, titanium alloys, tantalum, tantalum alloys, zirconium, zirconium alloys, niobium, niobium alloys, tungsten and tungsten alloys.

6. The method of claim 1, wherein said noble metal compound is selected from the group consisting of compounds of platinum, iridium, rhodium, palladium, ruthenium, osmium and mixtures thereof.

7. The method of claim 1, wherein said barrier precursor forming composition comprises a ruthenium salt and an organic titanium compound.

8. The method of claim 7, wherein the salt is ruthenium chloride and the titanium compound is butyl titanate.

9. The method of claim 1, wherein an essentially continuous coating is formed on said base from said first composition.

10. The method of claim 1, wherein ethylene glycol is the reducing agent present in said second composition.

11. A method for making an electrode suitable for use in an electrochemical process as claimed in claim 1 wherein the baking temperature is 400°-475° C.

12. The method of claim 1, wherein there is additionally carried out a post-bake step comprising heating at a temperature of more than 475° C.

* * * * *